United States Patent [19]

Sudo

[11] 3,952,454

[45] Apr. 27, 1976

[54] DEVICE FOR SEALING DOORS OF COKE OVEN

[75] Inventor: Osamu Sudo, Fijisawa, Japan

[73] Assignee: Nippon Oil Seal Industry Co., Ltd., Japan

[22] Filed: Aug. 2, 1974

[21] Appl. No.: 494,363

[52] U.S. Cl. ..... 49/480; 49/485; 49/494; 202/248

[51] Int. Cl.[2] ..... E06B 7/22; C10B 25/06

[58] Field of Search ..... 49/480, 481, 485, 493, 49/494, 498, 482, 475; 202/242, 248; 277/164, 150, 149

[56] References Cited

UNITED STATES PATENTS

| | | | |
|---|---|---|---|
| 992,793 | 5/1911 | Miner | 49/480 |
| 1,873,076 | 8/1932 | Van Ackeren | 202/248 |
| 1,980,720 | 11/1934 | Field et al. | 49/475 X |
| 2,130,017 | 9/1938 | Lewis | 49/493 X |
| 2,662,053 | 12/1953 | Brown | 202/248 X |
| 2,778,785 | 1/1957 | Otto | 202/248 |
| 2,825,940 | 3/1958 | Kurtz | 49/480 X |
| 2,923,984 | 2/1960 | Jecmen | 49/494 |
| 3,382,619 | 5/1968 | Bemis | 49/493 |

*Primary Examiner*—Philip C. Kannan
*Attorney, Agent, or Firm*—Holman & Stern

[57] ABSTRACT

A device for sealing a door of a coke oven includes a ring-shaped steel packing fitted over an outer surface of the door so as to contact a side wall of the coke oven when the door is closed, a packing retainer fitted over the outer surface of the steel packing and provided with a ring-shaped groove opened toward the side wall and a ring-shaped packing assembly fitted into the groove so as to press against the side wall. The packing assembly extends closer to the side wall of the coke oven than the steel packing.

4 Claims, 12 Drawing Figures

DEVICE FOR SEALING DOORS OF COKE OVEN

BACKGROUND OF THE INVENTION

The present invention relates to a device for sealing doors of coke ovens.

One of the problems encountered in the operation of a coke oven concerns the leakage of gases and dusts from the coke oven because of insufficient sealing between doors and the side walls of the oven.

The above problem is discussed below with reference to a conventional coke oven as shown in FIGS. 1 and 2 of the drawings.

Referring to FIGS. 1 and 2, a plurality of steel doors 1 are installed on both sides of a coke oven 9. Coal is charged through a plurality of charging holes 11 formed through the top of the coke oven 9 into a coke oven chamber 10. Gases and dusts produced in coke production are collected through a discharge passage 12 to a gas and dust collecting apparatus (not shown). When the coal is completely turned into coke, the heating operation is stopped and the steel doors 1 are opened so that the coke may be shoved from the doors 1 on one side of the coke oven to the doors on the other side. In early coke ovens, an annular or ring-shaped steel packing 4 is interposed between the steel door 1 and a side wall of the coke oven in order to seal the coke oven. However, both the annular steel packing 4 and the side wall of the coke oven against which is pressed the steel packing 4 are not elastic so that complete sealing cannot be attained when the sealing surfaces are not smooth or distorted. As a result, the gases and dusts produced when the coke is manufactured escape out of the coke oven, thus resulting in atmospheric pollution.

SUMMARY OF THE INVENTION

In view of the above problem, the primary object of the present invention is to dispose an elastic member around the outer periphery of a conventional steel packing so that the elastic member may be elastically pressed against the side wall of the coke oven to completely prevent the leakage of the gases and dusts from the coke oven chamber into the surrounding atmosphere.

BRIEF DESCRIPTION OF THE DRAWINGS

The present invention will become more apparent from the following description of several preferred embodiments thereof taken in conjunction with the accompanying drawings in which.

DETAILED DESCRIPTION OF PREFERRED EMBODIMENTS

Figure 1:
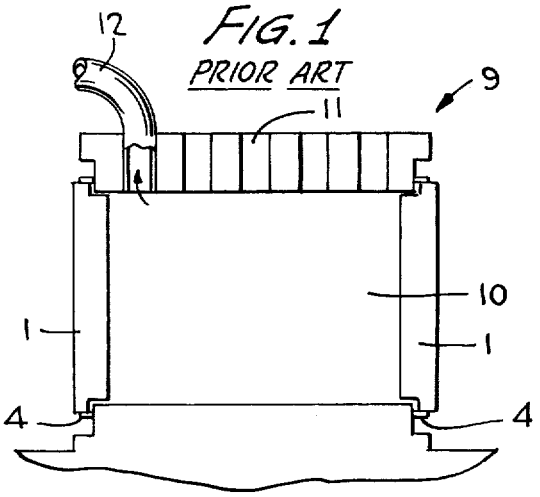
FIG. 1 PRIOR ART
FIG. 1 is a schematic sectional view of a conventional coke oven.
Figure 2:
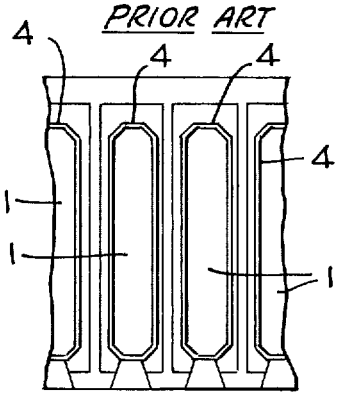
FIG. 2 PRIOR ART
FIG. 2 is a fragmentary side view of the coke oven shown in FIG. 1.
Figure 3:
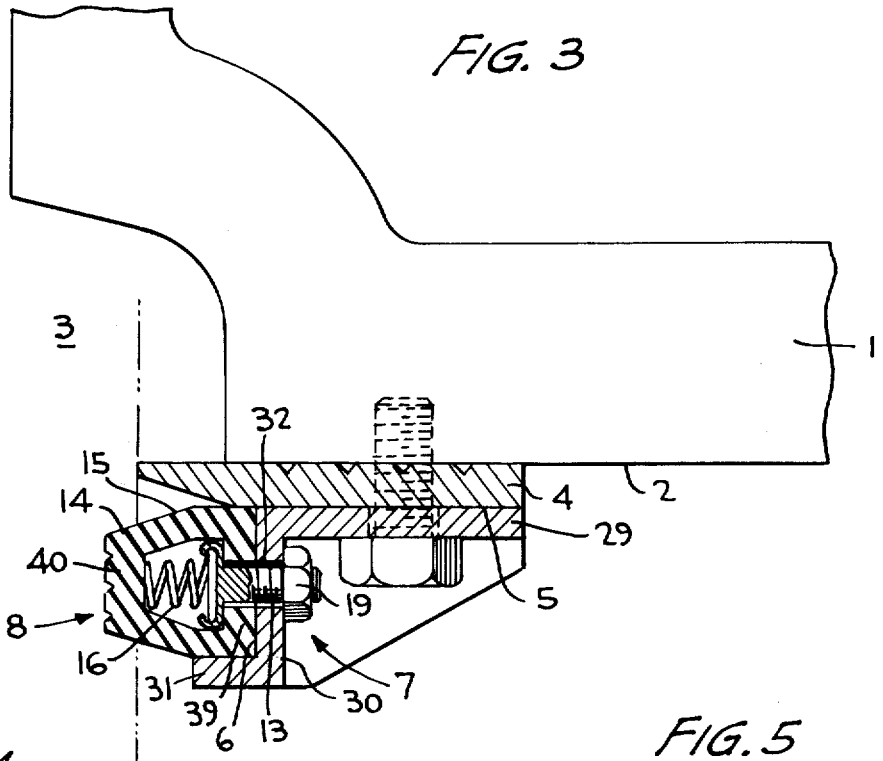
FIG. 3 is a fragmentary view, partly in section, of a first embodiment of a device for sealing doors of a coke oven.

A first embodiment of the device for sealing doors of a coke oven is shown in FIG. 3.

Referring to FIG. 3, around the outer surface 2 of the steel door 1 is fitted a ring-shaped steel packing 4 whose one end portion on the side of the side wall 3 of the coke oven is in the form of a wedge. Over the steel packing 4 is fitted a ring-shaped packing gland or retainer 7 comprising a cylindrical portion 29 closely fitted over the outer surface 5 of the steel packing 4, a flange portion 30 which extends radially outwardly from the inner end of the cylindrical portion 29 and which is provided with a plurality of bolt holes 32, and a cylindrical portion 31 extending inwardly toward the side wall 3 from the outer side of the flange 30. A ring-shaped packing 8 is fitted into a ring-shaped groove 6 defined by the outer surface of the steel packing 4, the flange portion 30 and the cylindrical portion 31 of the packing retainer 7 and opened toward the side wall 3 of the coke oven.

The packing 8 has a ring-shaped cross-sectional configuration, and generally comprises an elastic member 14 made of a heat resisting rubber such as fluoro rubber and provided with an opening 13 formed through the rear section 39 in the longitudinal direction, a spring stop 15 disposed within the elastic member 14 in contact with the rear section 39, and a plurality of springs 16 loaded between the inside wall on the side of the front wall section 40 of the rubber member 14 and the spring stop 15. The packing 8 is securely joined to the packing retainer 7 by a plurality of bolts 19 which extend through the openings 13. The bolts are joined to the spring stop 15 by welding.

The front wall section 40 of the elastic member 14 extends more closer to the side wall 3 than the wedge-shaped end of the steel packing 4 and is forced to be pressed against the side wall 3 when the door 1 is closed.

Figure 4:
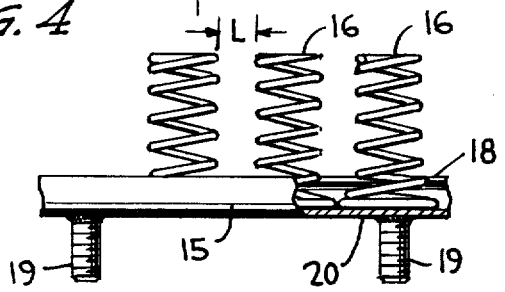
FIG. 4 is a side view, partly in section, of a spring retainer and springs shown in FIG. 3.
Figure 5:
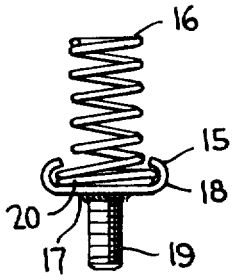
FIG. 5 is a sectional view of the spring retainer and springs shown in FIG. 4.
Figure 3A:
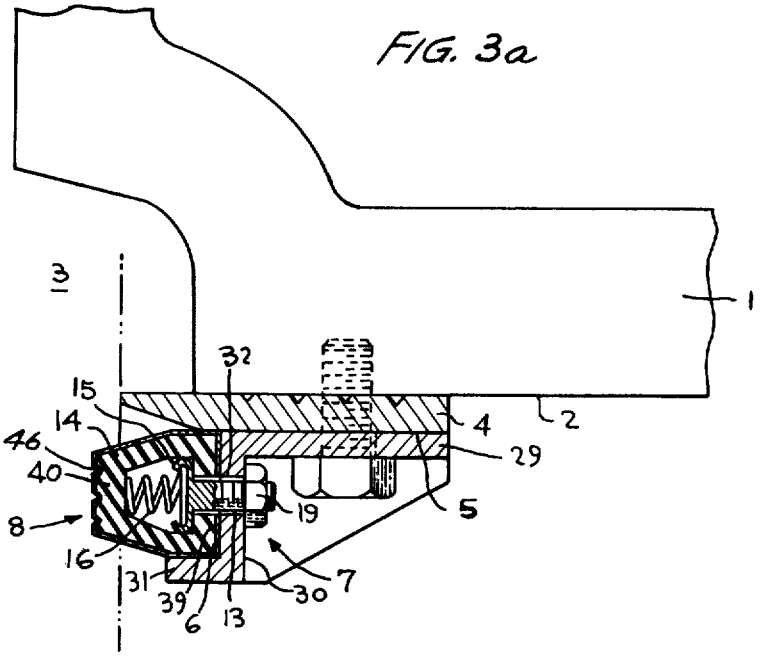
FIGS. 3*a*, 6*a*, 7*a* and 8*a* are fragmentary views, partly in section, of the four embodiments of FIGS. 3, 6, 7 and 8, respectively, showing the metallic covering over the packing assembly.

FIGS. 4 and 5 show the construction of the springs 16 and the spring stop 15. The spring stop 15 comprises a bottom section 17 made into contact with the inner wall of the rear section 39 and flange sections 18 bent inwardly from both sides of the bottom section 17 so as to retain the springs 16 therebetween. The plurality of bolts 19 are joined to the bottom section 17 by welding so that the spring stop 15 is fixed to the packing retainer 7. The diameter of the coil 20 of the spring 16 which is held by the spring stop or retainer 15 is made larger than that of the remaining coils so that the adjacent bottom coils contact each other as best shown in FIG. 4. The adjacent springs 16 are spaced apart from each other by a distance L (See FIG. 4).

Figure 6:
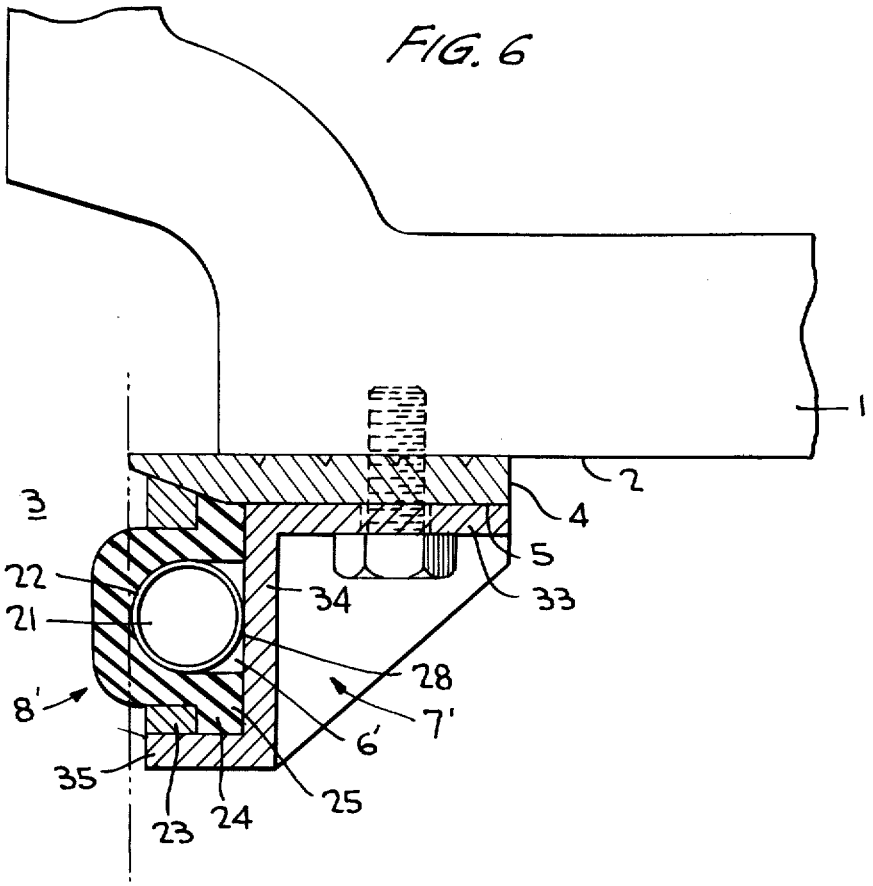
FIG. 6 is a fragmentary view, partly in section, of a second embodiment of a device for sealing doors of a coke oven.

A second embodiment of the device for sealing doors of a coke oven is shown in FIG. 6.

Referring to FIG. 6, over the outer surface 2 of the steel door 1 is fitted the ring-shaped steel packing 4 substantially similar in construction to that described above with reference to FIG. 3. Over the outer surface 5 of the steel packing 4 is fitted a ring-shaped packing gland or retainer 7' which is similar in construction to that of the first embodiment (See FIG. 3) and generally comprises a cylindrical section 33 closely fitted over the steel packing 4, a flange section 34 extending radially outwardly from the inner end of the cylindrical section 33, and a cylindrical section 35 extending inwardly toward the side wall 3 from the outer side of the flange section 34. A ring-shaped packing assembly 8′ is disposed within a ring-shaped groove 6′ defined by the ring-shaped packing retainer 7′ and the ring-shaped steel packing 4 and opened toward the side wall 3 of the coke oven.

The packing assembly 8′ has a U-shaped cross-sectional configuration with an opening 28 and has its front end (the lower end in FIG. 6) extended more towards the side wall 3 than the steel packing 4 does. Within the ring-shaped space 21 of the packing assembly 8′ is disposed a tube 22 made of an elastic material so that cooling water may circulate through this tube 22. A flange section 24 of the packing assembly 8′ which extends outwardly is snuggly fitted into a recess 25 defined by a projection 23 extended radially from the inside wall of the cylindrical section 35 of the packing retainer 7′ and the flange section 34 thereof.

Figure 7:
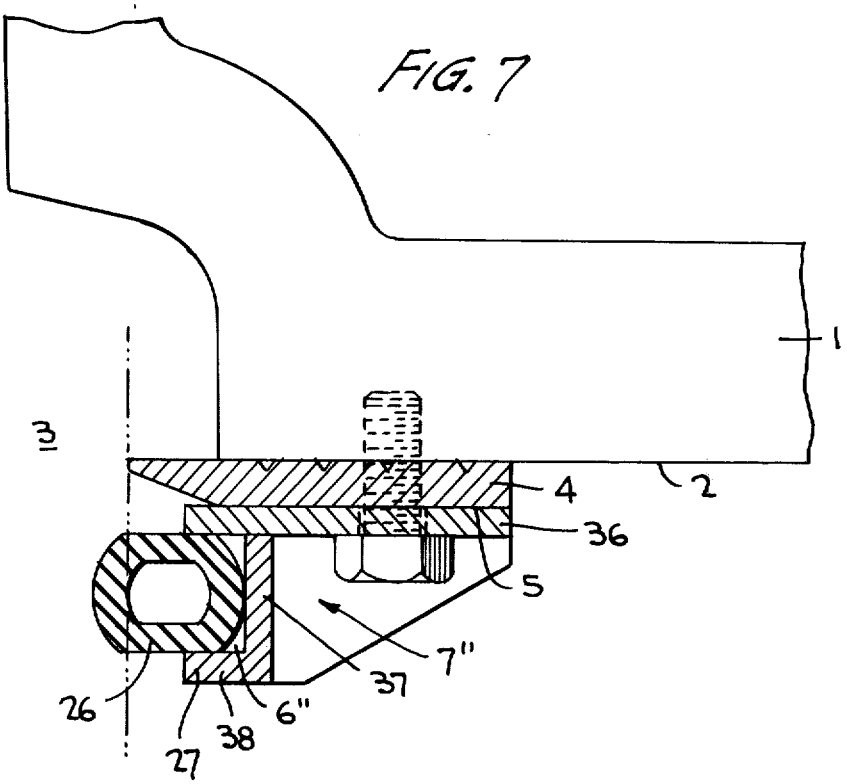
FIG. 7 is a fragmentary view, partly in section, of a third embodiment of a device for sealing doors of a coke oven.
Figure 6A:
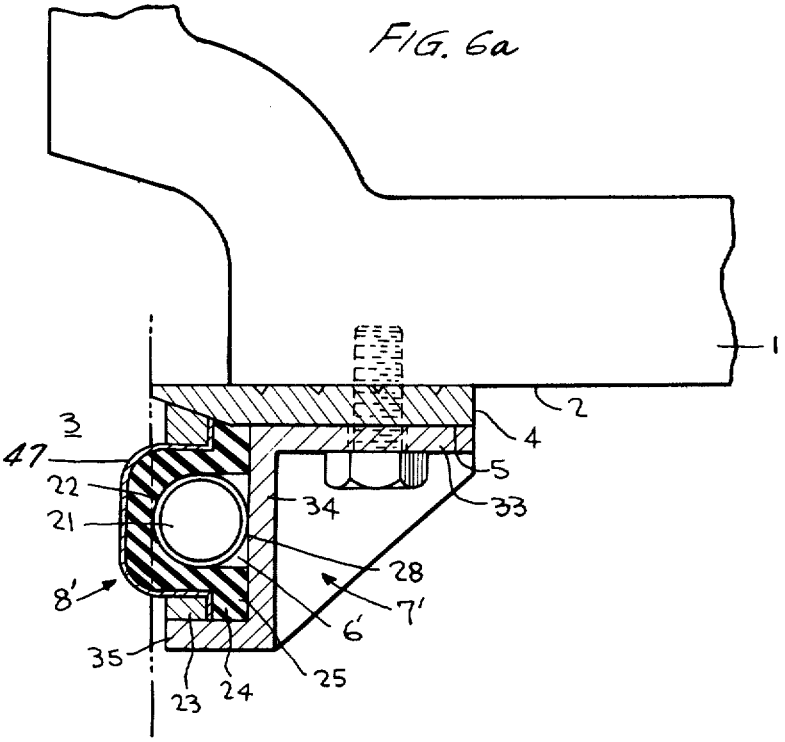

A third embodiment of the device for sealing doors of a coke oven is shown in FIG. 7.

Figure 7A:
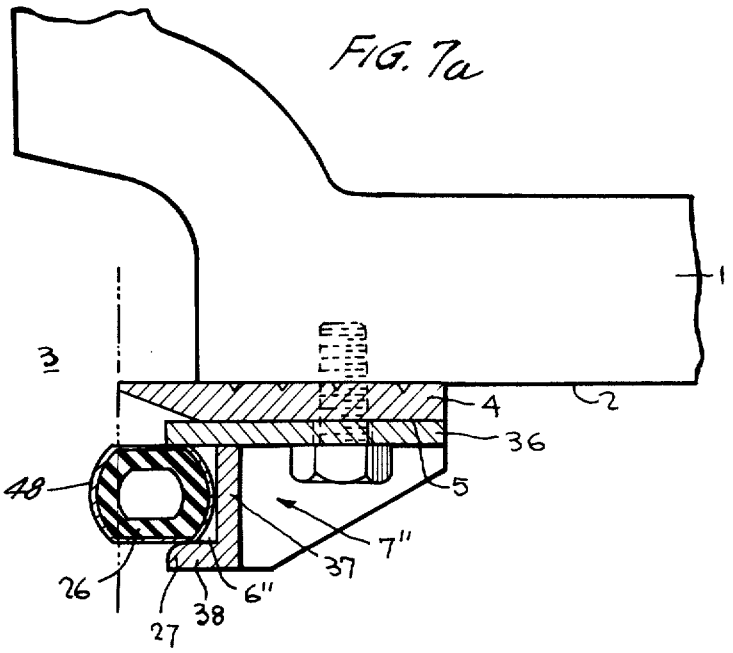

Referring to FIG. 7, over the outer surface 2 of the steel door 1 is fitted the ring-shaped steel packing 4 whose construction is substantially similar to that described above with reference to FIG. 3. Over the steel packing 4 is fitted a ring-shaped packing gland or retainer 7″ comprising a cylindrical section 36 closely fitted over the outer surface 5 of the steel packing 4, a flange section 37 extending radially outwardly from the cylindrical section 36, and a cylindrical section 38 extending inwardly toward the side wall 3 of the coke oven from the outer side of the flange section 37. A hollow O-ring 26 is fitted into a ring-shaped groove 6″ defined within the packing retainer 7″ and opened toward the side wall 3. Like the first and second embodiments, the front side (the lower side in FIG. 7) of the O-ring is extended more towards the side wall 3 than the steel packing 4. The inner side 27 of the inner end of the cylindrical section 38 of the packing retainer 7″ is rounded as to not scar the O-ring 26 when the O-ring is pressed against the side wall 3 (FIG. 7*a*).

Figure 8:
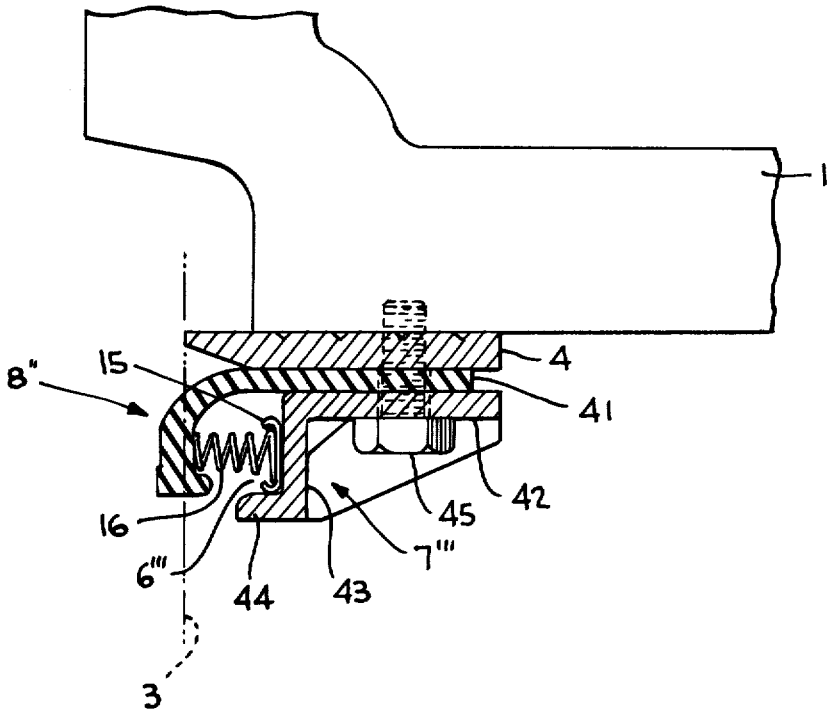
FIG. 8 is a fragmentary view, partly in section, of a fourth embodiment of a device for sealing doors of a coke oven.
Figure 8A:
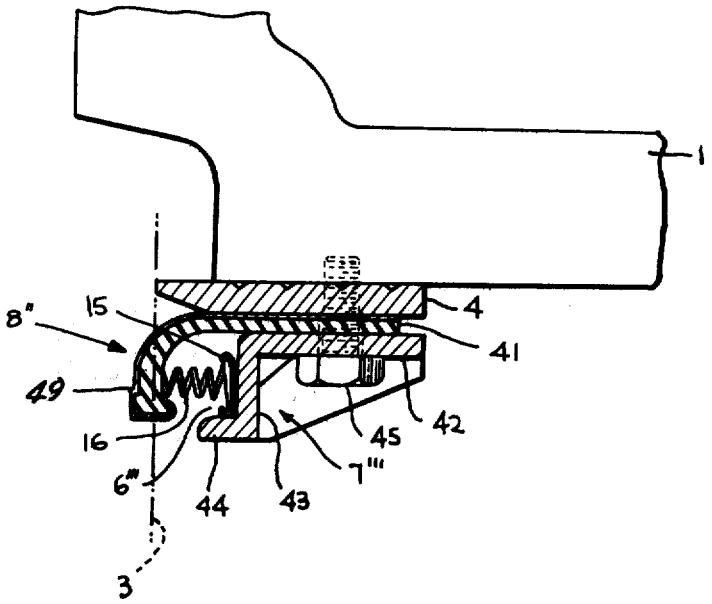

A fourth embodiment of the device for sealing doors of a coke oven is shown in FIG. 8.

Referring to FIG. 8, over the outer surface of the steel door 1 is fitted the steel packing 4 whose construction is substantially similar to that described in detail with reference to FIG. 3. Over the outer surface of the steel packing 4 is fitted a ring-shaped packing 8″ which is made of a heat resisting rubber such as fluoro or silicon rubber and which has a L-shaped cross-sectional configuration. More particularly, a flange section 41 of the packing 8″ is made into close contact with the steel packing 4 and held in position by a ring-shaped packing gland or retainer 7‴ comprising a cylindrical section 42 formed coaxially of the steel packing 4, a flange section 43 extending radially outwardly from the inner end of the cylindrical section 42 and a cylindrical section 44 extending from the outer side of the flange section 43 inwardly toward the side wall 3. The steel packing 4, the packing 8″ and the packing retainer 7‴ are securely joined to the steel door 1 with set bolts 45. Within a ring-shaped groove 6‴ defined by the flange section 43 and the cylindrical section 44 of the packing retainer 7‴ are disposed the springs 16 and the spring stop or retainer 15 of the type described hereinbefore with reference to FIGS. 4 and 5. The spring stop or retainer 15 is made into contact with the inner surface of the flange section 43 of the packing retainer 7‴, and the springs 16 are loaded between the spring retainer 15 and the packing 8″ so as to press the packing 8″ toward the side wall 3 when the steel door 1 is closed.

When the steel door 1 is closed, the front end of the steel packing 4 is pressed against the side wall 3 of the coke oven so that the leakage of gases and dusts is prevented to some extent. The gases and dusts which pass through the steel packing 4 are completely prevented from leaking by the elastic packing 8, 8′ or 8″ which is pressed against the side wall 3 of the coke oven. Furthermore, since the elastic packing 8, 8′ or 8″ is disposed in side-by-side relation with the steel packing 4, the extreme deformation of the steel packing is prevented.

It is preferable that the elastic packing 8, 8′, 8″ or hollow O-ring 26 be covered with a thin metallic lining, a metallic film or foil 46, 47, 48 and 49, FIGS. 3*a*, 6*a*, 7*a* and 8*a*, respectively for preventing burning by flames leaked out between the steel packing 4 and the side wall 3 of the coke oven.

As described hereinbefore, according to the present invention, the leakage of gases and dusts from the coke oven is completely prevented so that the atmospheric pollution problem is overcome.

I claim:

1. A device for sealing a steel door of a coke oven comprising: a ring-shaped steel packing fitted over an outer surface of the steel door so as to contact a side wall of the coke oven when the steel door is closed; a packing retainer fitted over and joined to the outer surface of the steel packing and provided with a ring-shaped groove opened toward the side wall of the coke oven; a ring-shaped packing assembly fitted into the groove so as to press elastically against the side wall when the steel door is closed, thereby sealing the steel door; the packing assembly extending closer to the side wall of the coke oven than the steel packing and comprising an elastic member having a front section and a rear section with an opening, a spring stop disposed within the elastic member in contact with the rear section and a plurality of springs loaded between the inner side wall of the front section of the elastic member and the spring stop; the spring stop comprising a bottom section in contact with the inner wall of the rear section of the elastic member and flange sections bent inwardly from both sides of the bottom section so as to retain the springs therebetween; and each of the springs having a bottom coil of larger diameter than the remaining coils and the bottom coil being held between the flange sections of the spring stop so that the remaining coils of the springs are spaced apart from each other.

2. The device as claimed in claim 1 wherein the packing retainer comprises a cylindrical portion fitted over the outer surface of the steel packing, a flange portion extending radially outward from the end of the cylindrical portion toward the side wall and provided with bolt holes and a cylindrical portion extending inwardly toward the side wall from the outer side of the flange portion.

3. The device as claimed in claim 1 wherein the packing assembly is joined to the packing retainer by a plurality of bolts which extend through the bolt holes of the flange portion of the packing retainer and the opening in the rear section of the elastic member and are joined to the spring stop.

4. The device as claimed in claim 1, further comprising a metallic covering disposed over the packing assembly.

* * * * *